US006578774B1

(12) United States Patent
Noyes

(10) Patent No.: US 6,578,774 B1
(45) Date of Patent: Jun. 17, 2003

(54) WATER SHEETING MANIFOLD

(76) Inventor: Michael S. Noyes, P.O. Box 891387, Temecula, CA (US) 92589

( * ) Notice: Subject to any disclaimer, the term of this patent is extended or adjusted under 35 U.S.C. 154(b) by 0 days.

(21) Appl. No.: 10/160,898

(22) Filed: Jun. 3, 2002

(51) Int. Cl.[7] ..... B05B 17/08

(52) U.S. Cl. ..... 239/17; 239/590.3; 239/23; 239/211; 4/678; 4/496

(58) Field of Search ..... 239/17, 193, 597, 239/598, 590.3, 23, 211, 590.5; 4/509, 507, 678, 496

(56) References Cited

U.S. PATENT DOCUMENTS

| | | | | |
|---|---|---|---|---|
| 4,881,280 A | * | 11/1989 | Lesikar | 4/507 |
| 5,249,744 A | * | 10/1993 | Ruthenberg | 239/23 |
| 5,309,581 A | | 5/1994 | Lockwood | |
| 5,388,285 A | | 2/1995 | Belniak | |
| 5,537,696 A | | 7/1996 | Chartier | |
| 5,893,179 A | * | 4/1999 | Johnson | 4/507 |
| 6,170,094 B1 | * | 1/2001 | Weise et al. | 4/507 |
| 6,450,418 B1 | * | 9/2002 | Simpson et al. | 239/17 |

OTHER PUBLICATIONS

Product Catalog of Oreq Corporation, Temecula, California, for customcascade water features, showing a copyright date of 2000.

* cited by examiner

*Primary Examiner*—Gregory L. Huson
*Assistant Examiner*—Amanda Flynn
(74) *Attorney, Agent, or Firm*—Loyal McKinley Hanson

(57) ABSTRACT

A water sheeting manifold includes an enclosure having a hollow interior with a plurality of water-spreading chambers and a plurality of chamber-connecting passageways. The enclosure includes a water inlet that conveys a flow of water into the hollow interior and a water outlet that conveys the flow of water out of the hollow interior in the form of a sheet of water. The enclosure includes opposite first and second ends and first and second sides extending between the first and second ends. The first and second sides including a plurality of sections cooperating with the first and second ends to define the water-spreading chambers and chamber-connecting passageways without other chamber-defining structure and passageway-defining structure within the interior of the enclosure. The first and second sides of the enclosure may be extruded or welded together as separate components after being bent into the desired shape.

8 Claims, 4 Drawing Sheets

WATER SHEETING MANIFOLD

BACKGROUND OF THE INVENTION

1. Technical Field

This invention relates generally to decorative water features, including waterfalls, water fountains and the like used for landscaping and other decorative purposes. More particularly, it relates to a water sheeting manifold that discharges water in a sheet in order to provide a desired waterfall effect.

2. Description of Related Art

The term "water sheeting manifold" herein means a water discharge fitting that produces a sheet of water for landscaping and/or other decorative purposes. It is sometimes referred to, among other things, as an enclosure, a water box, a water containment vessel, a water apparatus, and/or a water feature unit or device. The enclosure has a hollow interior with a plurality of water-spreading chambers and a plurality of chamber-connecting passageways that result in a sheet of water.

A water supply pipe or other conduit supplies water to a water inlet portion of the enclosure. The enclosure conveys the water via the water-spreading chambers and chamber-connecting passageways to a water outlet on the enclosure. As that occurs, the water-sheeting manifold causes the water to discharge through the water outlet in a thin, broad stream or sheet (i.e., a water sheet or sheet of water) in order to produce a desired decorative effect.

Water sheeting manifolds are well known and commonly used components. Reference may be made to U.S. Pat. No. 4,881,280 and United States Patent application Publication No. US 2001/0018776 A1 for examples of some water sheeting manifolds and their construction.

The water-spreading chambers within the enclosure cause the water to spread laterally as it flows from the inlet to the outlet. They do that in order to produce a sheet of water at the outlet. Typically, the enclosure includes three such chambers and the related chamber-connecting passageways.

Baffles or other water diverting and diffusing plates and/or other structures are typically tack-welded in place within the enclosure to define the desired chambers and passageways. The problem is that fabrication time and cost can be significant. In addition, welds within the chamber sometimes corrode to the point where the flow of water is affected and the water sheeting manifold must be replaced at additional significant cost. Thus, users need a water sheeting manifold that alleviates those concerns.

SUMMARY OF THE INVENTION

It is an object of this invention to alleviate the forgoing and other disadvantages of prior art water sheeting manifolds. This object is achieved by providing a water sheeting manifold having an enclosure with sides that define water-spreading chambers and chamber-connecting passageways within the enclosure without flow-controlling baffles or other water-diverting and diffusing structures within the enclosure. Thus, fabrication costs are less and corrosion of chamber-defining and passageway-defining structure within the interior of the enclosure is avoided.

The illustrated embodiments accomplish this and more. Preferably, the water inlet includes a fitting set at forty-five degrees relative to horizontal in order to facilitate installation irrespective of water supply pipe orientation. In addition, the first and second sides of the enclosure of one embodiment are extruded, while those of a second embodiment are separate components that are bent into a desired shape and then welded together.

To paraphrase some of the more precise language appearing in the claims, a water sheeting manifold constructed according to the invention includes an enclosure having a hollow interior with a plurality of water-spreading chambers and a plurality of chamber-connecting passageways. The enclosure includes water inlet means for conveying a flow of water into the hollow interior. It also includes water outlet means for conveying the flow of water from the hollow interior in the form of a sheet of water.

The enclosure has opposite first and second ends and first and second sides extending between the first and second ends. According to a major aspect of the invention, the first and second sides include a plurality of sections that cooperate with the first and second ends to define the water-spreading chambers and chamber-connecting passageways without other chamber-defining structure and passageway-defining structure within the enclosure. According to another aspect of the invention, the water inlet means includes a fitting that extends from the enclosure at a forty-five degree angle relative to horizontal, when the enclosure is in a predetermined installation orientation, in order to thereby facilitate connection of the fitting to a separate water supply pipe irrespective of the water supply pipe orientation relative to horizontal. The following illustrative drawings and detailed description make the foregoing and other objects, features, and advantages of the invention more apparent.

DESCRIPTION OF THE PREFERRED EMBODIMENTS

Figure 1:
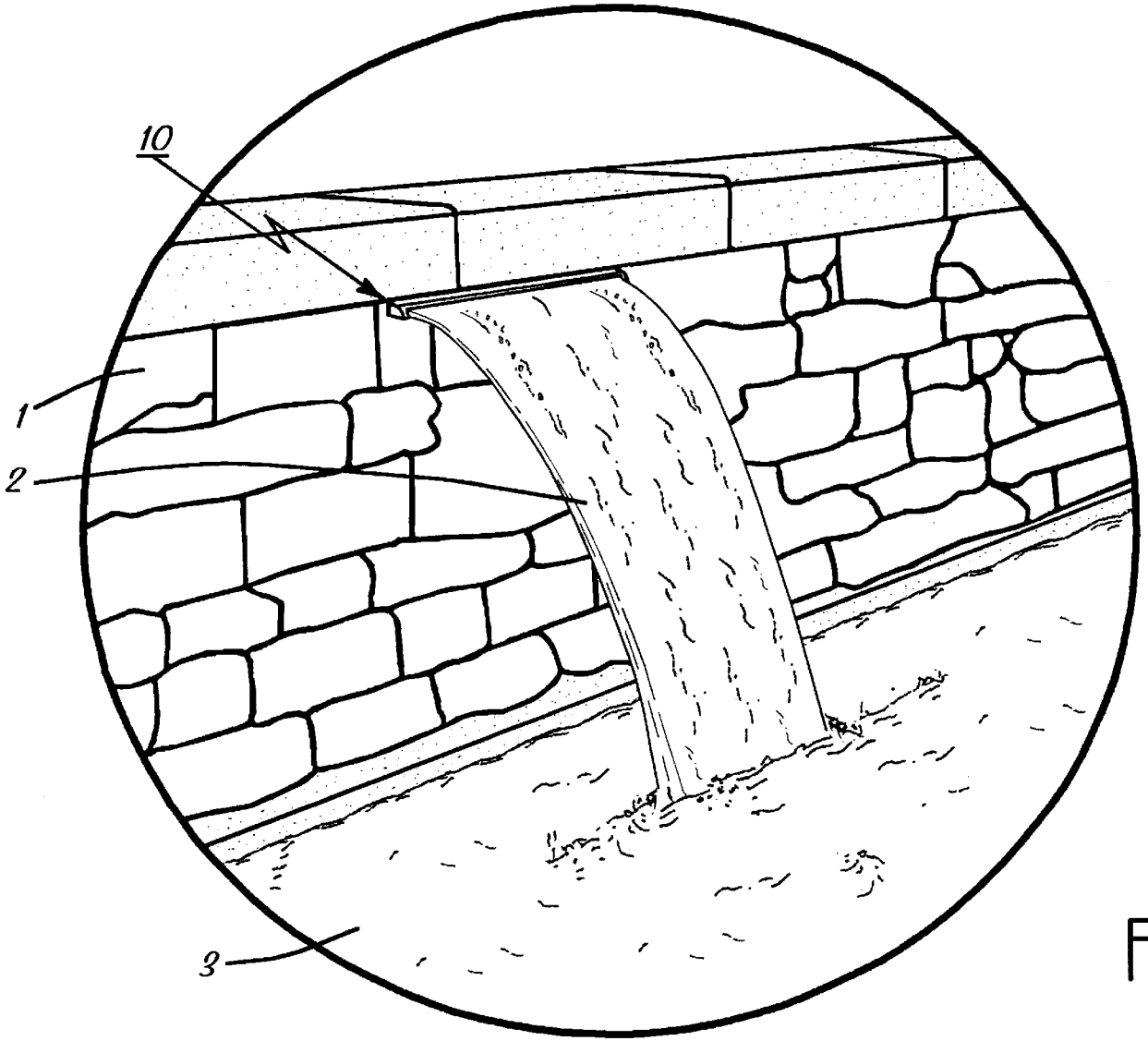
FIG. 1 of the drawings is a rendition of a water sheeting manifold constructed according to the invention that is depicted in a typical environment, installed in a field stone wall to discharge a sheet of water into an adjacent pool of water.
Figure 2:
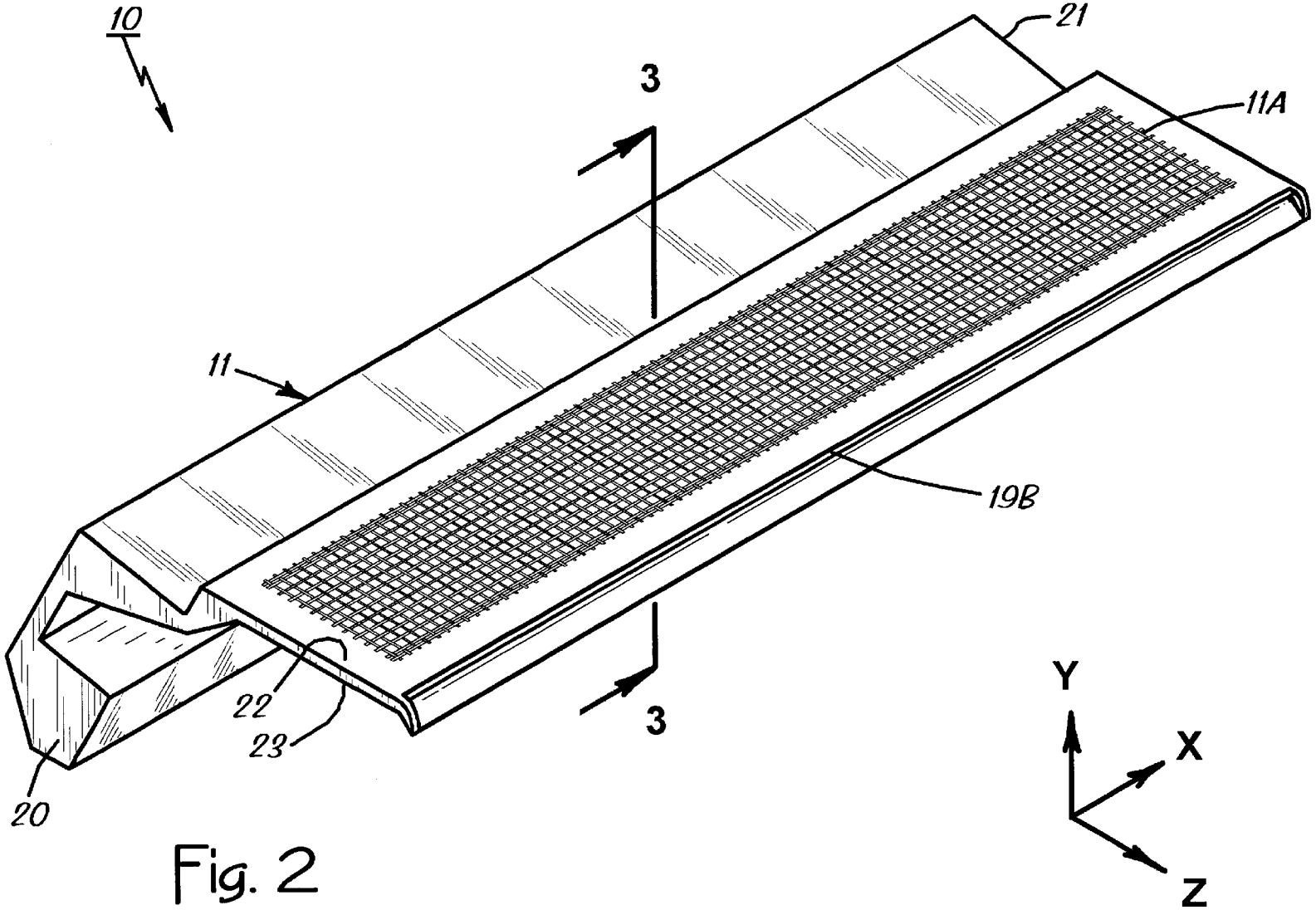
FIG. 2 is an enlarged isometric view of just the water sheeting manifold, with an X-Y-Z Cartesian coordinate system illustrated for reference.
Figure 3:
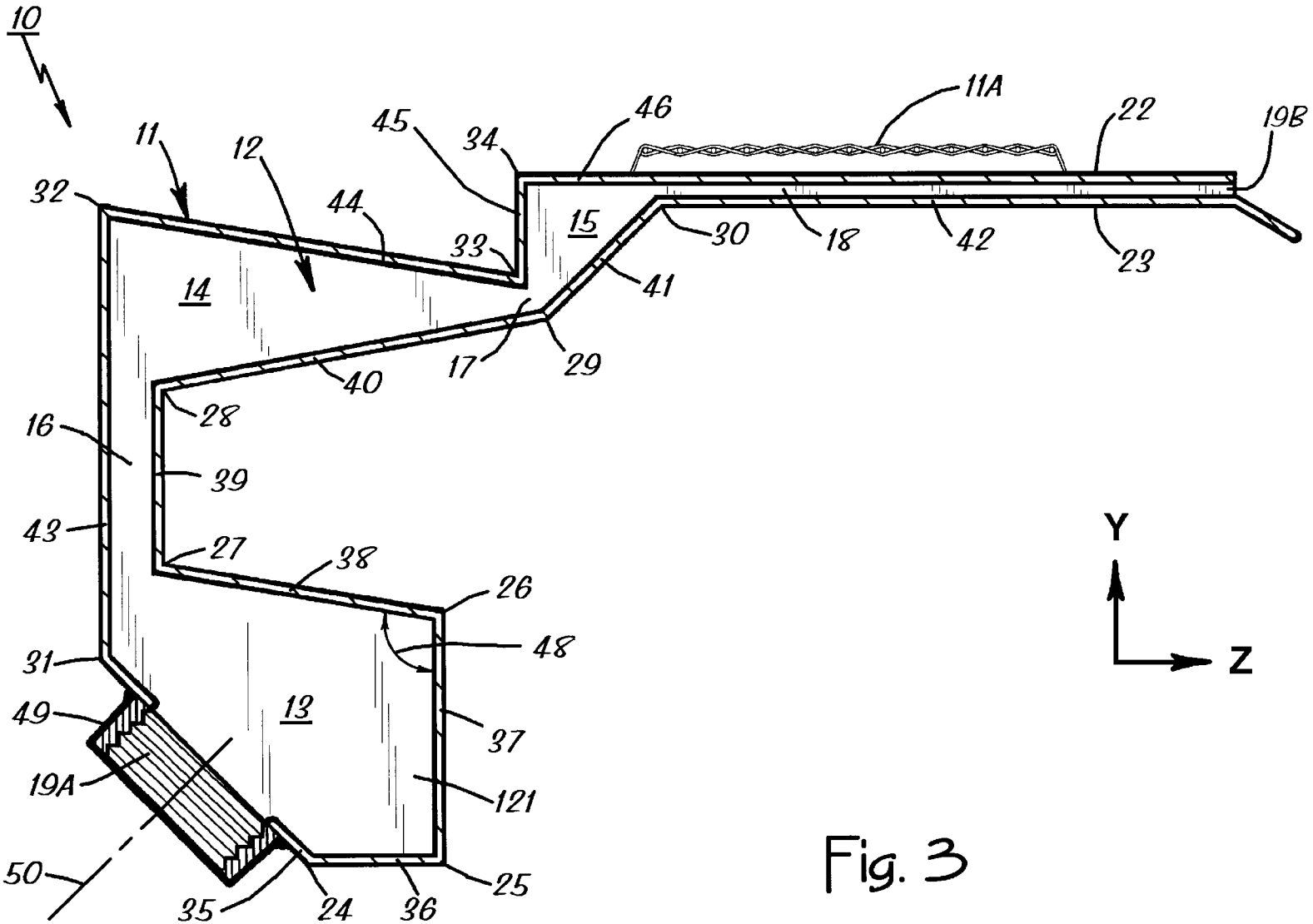
FIG. 3 is a cross sectional view of the water sheeting manifold as viewed in a plane parallel to the Z and Y axes that contains a line 3—3 in FIG. 2.

FIGS. 1–3 of the drawings show various aspects of a water sheeting manifold 10 constructed according to the invention. The water sheeting manifold 10 is depicted in FIG. 1 in a typical environment. It is installed in a field stone wall 1 where it discharges a sheet of water 2 into a pool 3. The sheet of water 2 simulates a water fall for decorative purposes.

The illustrated water sheeting manifold 10 is composed of 14 gauge, 0.090-inch thick, surgical grade stainless steel. It is about two feet long measured horizontally along the face of the wall 1, about five inches high, and about nine inches deep. Most of the water sheeting manifold 10 is not visible in FIG. 1 because it is mounted within the wall 1 along with a water supply pipe that supplies water to fitting on the back side of the water sheeting manifold 10. Of course, a water sheeting manifold constructed according to the invention may be made of other materials (e.g., plastic) and with different dimensions without departing from the inventive concepts disclosed.

Further details of the water sheeting manifold 10 are shown in FIGS. 2 and 3. Generally, the water sheeting manifold 10 includes an enclosure 11 (FIGS. 2 and 3) having a hollow interior 12 that is visible in FIG. 3 and an attached wire mesh 11A for concrete or mortar to grip. The hollow interior 12 includes a plurality of water-spreading chambers that are identified in FIG. 3 as first, second, and third water-spreading chambers 13, 14, and 15, and it includes a plurality of chamber-connecting passageways that are identified in FIG. 3 as first, second, and third chamber-connecting passages 16, 17, and 18. The enclosure 11 also includes a water inlet 19A (FIG. 3) that function as means for conveying a flow of water into the hollow interior 12, and a water outlet 19B (FIGS. 2 and 3) that function as means for conveying the flow of water from the hollow interior 12 in the form of the sheet of water 2 shown in FIG. 1.

Water flowing from a separate water supply pipe (not shown) that is connected to the water inlet 19A, flows via the water inlet 19A into the first water-spreading chamber 13. From there, the water flows via the first chamber-connecting passageway 16 to the second water-spreading chamber 14, then via the second chamber-connecting passageway 17 to the third water-spreading chamber 15, and from there via the third chamber-connecting passageway 18 to the water outlet 19B and out of the water outlet 19B in the form of the sheet of water 2. The first, second, and third water-spreading chambers 13, 14, 15 function in a known way by allowing the water to spread laterally parallel to the X axis as the water flows through the enclosure 11 to the water outlet 19B in order to thereby develop the width of the sheet of water 2. The first, second, and third chamber-connecting passageways 16, 17, and 18 function in a known way by connecting the first, second, and third water-spreading chamber 13 as illustrated.

The enclosure 11 includes first and second ends 20 and 21. It also it includes first and second sides 22 and 23 extending between the first and second ends 20 and 21. The first and second ends 20 and 21 combine with the first and second sides 22 and 23 to cooperatively enclose and define the hollow interior 12. In doing so, they define the first, second, and third water-spreading chambers 13, 14, and 15, and the first, second, and third chamber-connecting passageways 16, 17, and 18.

According to a major aspect of the invention, the first and second ends 20 and 21 and the first and second sides 22 and 23 cooperate to define the first, second, and third water-spreading chambers 13, 14, and 15 and the first, second, and third chamber-connecting passageways 16, 17, and 18, without other chamber-defining structure and passageway-defining structure within the hollow interior 12 of the enclosure 11. For that purpose, the first and second sides 22 and 23 include a plurality of at least eleven bends that are designated in FIG. 3 as a first bend 24 through an eleventh bend 34. The first through eleventh bends 24–34 extend laterally parallel to the X axis (and perpendicular to the YZ plane) between the first and second ends 20 and 21 and they divide the first and second sides 22 and 23 into twelve sections that are designated in FIG. 3 as a first section 35 through a twelfth section 46. The first through twelfth sections 35–46 cooperate with the first and second ends 20 and 21 to define the first, second, and third water-spreading chambers 13, 14, and 15 together with the first, second, and third, chamber-connecting passageways 16,17, and 18, without other chamber-defining structure and passageway-defining structure within the hollow interior 12 of the enclosure 11.

Table A lists the twelve sections, the section widths, the eleven bends, and the bend angles. Only one bend angle 47 is identified in FIG. 3 by a double-headed arrow for illustrative convenience in order to avoid too many reference numerals. The bend angle 47 is the angle facing the hollow interior 12 of the bend 26 at the intersection of the sections 37 and 38. The other bend angles given in Table A also face the hollow interior 12 at the intersections of two the sections at the bend. Of course, section widths and bend angles apply for the illustrated water sheeting manifold 10. Based upon the foregoing description, one of ordinary skill in the art can readily vary the given geometry without departing from the broader inventive aspects disclosed and claimed.

The widths of each of the sections 35–46 of the first and second sides 22 and 23 of the water sheeting manifold 10 are measured parallel to the YZ plane of the illustrated XYZ coordinates. Those widths are stated in Table A in terms of one-inch measuring units, that being a selected linear measurement unit for the illustrated embodiments. The width of the first section 35, for example, is 2⅛ inches. The actual widths of a water sheeting manifold constructed according to the invention using the illustrated geometry may vary according to the measurement unit used, and one of ordinary skill can readily scale the given measurements (proportionately increase or decrease them) in order to implement the invention with a larger or smaller enclosure. The given dimensions are found to work well for a water sheeting manifold that measures in the range of about 12 inches to about 10 feet in length parallel to the X axis when installed with a 1½ inch diameter water supply pipe supplying water at a water flow in the range of about 5 to about 20 gallons per minute per foot of water manifold length.

TABLE A

| Section | Width (1" units) | Bend | Angle (degrees) |
|---|---|---|---|
| 1 | 2.125 | 1 | 135 |
| 2 | 0.75 | 2 | 90 |
| 3 | 2.125 | 3 | 100 |
| 4 | 2.0 | 4 | 260 |
| 5 | 0.875 | 5 | 260 |
| 6 | 2.25 | 6 | 155 |
| 7 | 1.25 | 7 | 215 |
| 8 | 4.75 | 8 | 135 |
| 9 | 3.0 | 9 | 80 |
| 10 | 2.25 | 10 | 280 |
| 11 | 0.625 | 11 | 90 |
| 12 | 6.0 | | |

Concerning fabrication, the first and second sides 22 and 23 may be bent into the desired shape and then welded together to form the enclosure 11 (e.g., along the bend 31). The first and second ends 20 and 21 are welded in place also. Other fabrication techniques may be employed, including injection molding of the first and second sides 22 and 23 as a one-piece extruded body of material without welding. The drawings are intended to illustrate and support the claims for both types of construction.

According to another aspect of the invention, the water inlet 18 enclosure 11 includes a fitting 49 (FIG. 3) for receiving a water of the enclosure 11 has a predetermined installation orientation relative to horizontal (i.e., the XZ plane) and the fitting 49 extends from the enclosure 11 along a central axis 50 of the fitting that extends at a forty-five degree angle relative to horizontal when the enclosure 11 is in the predetermined installation orientation. The forty-five degree angle of the fitting 49 facilitates connection of the fitting 49 to a separate water supply pipe irrespective of the water supply pipe orientation relative to horizontal.

Figure 4:
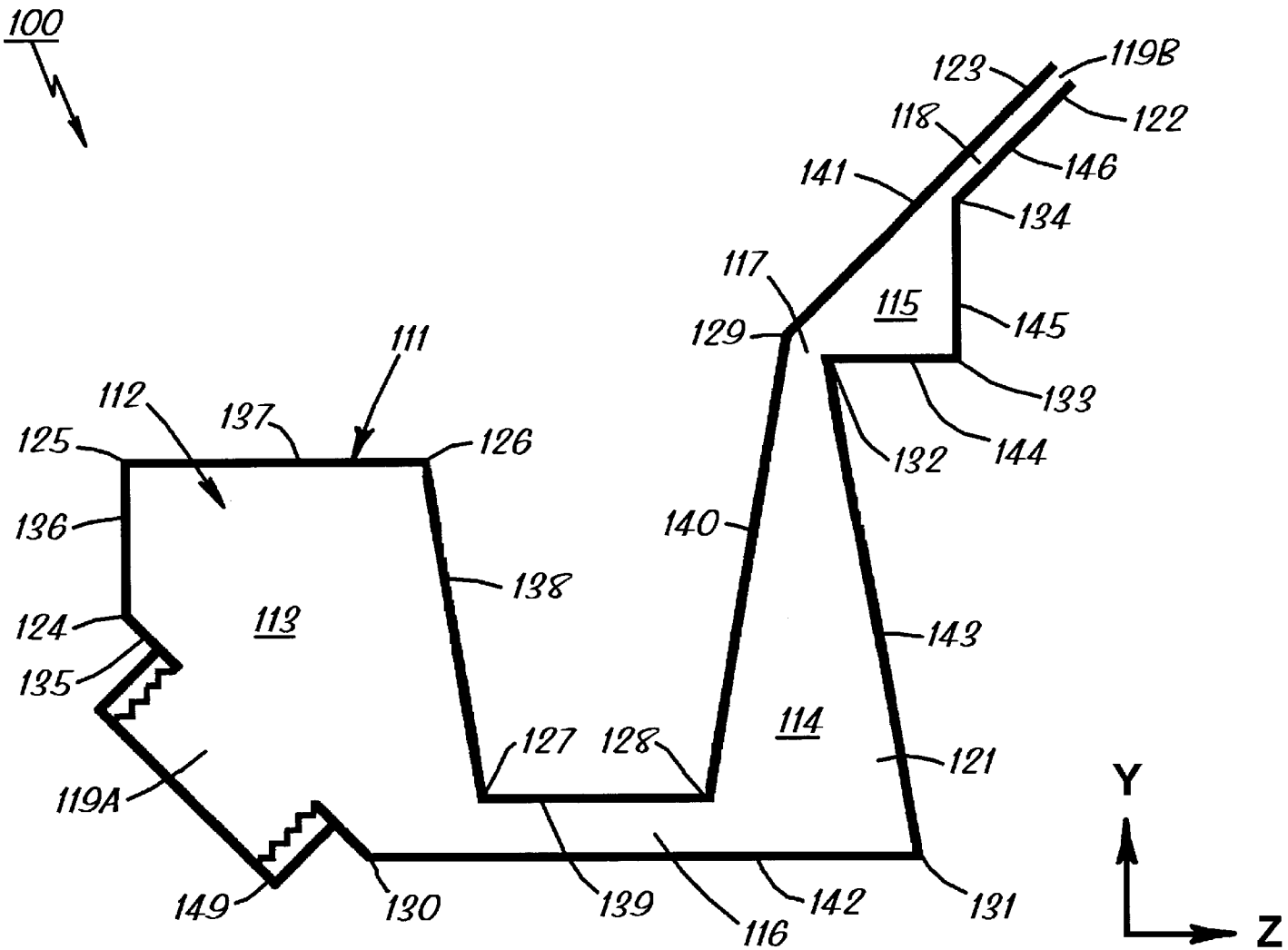
FIG. 4 is a diagrammatic representation of the cross section of a second embodiment of the invention that discharges a sheet of water upwardly and outwardly (the y and z directions) to produce a downwardly descending arc.

Now consider FIG. 4. It shows a second embodiment of a water sheeting manifold constructed according to the invention in the form of a water sheeting manifold 100. The water sheet manifold 100 is similar in many respects to the water sheeting manifold 10 and so only differences are described in further detail. For convenience, numerals designating parts of the water sheet manifold 100 are increased by one hundred over those designating corresponding or related parts of the water sheeting manifold 10.

Similar to the water sheeting manifold 10, the water sheeting manifold 100 includes a housing 111 with a hollow interior 112 having water-spreading chambers 113, 114, and 115, and chamber-connecting passageways 116, 117, and 118. The water sheeting manifold also includes a water inlet 119A and a water outlet 119B. First and second sides 122 and 123 cooperate with first and second ends to define the water-spreading chambers 113, 114, and 115, and the chamber-connecting passageways 116, 117, and 118. Only the second end 121 is identified in the diagrammatic representation of FIG. 4, but the first end is equivalent to the first end 20 of the water sheeting manifold 10 visible in FIG. 2.

A plurality of eleven bends 124–134 in the first and second sides 122 and 123 of the housing 111 divide the first and second sides 122 and 123 into to a plurality of twelve sections 135–146. The twelve sections 135–146 extend between the first and second ends of the housing 111, and they cooperate with the first and second ends to define the water-spreading chambers 113, 114, and 115, and the chamber-connecting passageways 116, 117, and 118 without other chamber-defining structure and passageway-defining structure within the hollow interior 112 of the enclosure 111. In addition, a fitting 149 (for receiving a water supply pipe) extends at a forty-five degree angle relative to horizontal.

The major difference in the water sheeting manifold 100 is the slightly different geometry that results in the passageway 118 extending upwardly and outwardly on an incline. That orientation results in a sheet of water being discharged outwardly and upwardly from the water outlet 119B. The sheet of water forms and arc as it leaves the water outlet 119B to eventually fall vertically, parallel to the Y axis, for a different decorative waterfall effect.

The widths of the sections 135–146 of the first and second sides 122 and 123 of the water sheeting manifold 100, measured parallel to the X axis of the illustrated XYZ coordinates, are stated below in Table B in terms of one-inch units of linear measurement. The claims also express section widths in terms of a selected unit of linear measurement. The scope of the claims is not limited by the actual physical size.

TABLE B

| Section | Width (1" units) | Bend | Angle (degrees) |
|---|---|---|---|
| 1 | 2.125 | 1 | 135 |
| 2 | 0.75 | 2 | 90 |
| 3 | 2.125 | 3 | 100 |
| 4 | 2.0 | 4 | 260 |
| 5 | 0.875 | 5 | 260 |
| 6 | 2.25 | 6 | 155 |
| 7 | 3.5 | 7 | 135 |
| 8 | 3.0 | 8 | 80 |
| 9 | 2.25 | 9 | 280 |
| 10 | 0.625 | 10 | 90 |
| 11 | 1.25 | 11 | 215 |
| 12 | 1.75 | | |

Thus, the invention provides providing a water sheeting manifold having an enclosure with sides that define water-spreading chambers and chamber-connecting passageways without flow-controlling baffles or other water-diverting and diffusing structures within the enclosure. Fabrication costs are less. Corrosion of chamber-defining and passageway-defining structure within the interior of the enclosure is avoided.

Although exemplary embodiments have been shown and described, one of ordinary skill in the art may make many changes, modifications, and substitutions without necessarily departing from the spirit and scope of the invention. The bends, for example, may be formed by actually bending the material of which the enclosures are made, or they may be an extruded body of material formed by injection molding the enclosures, or by other suitable means. The embodiments described herein are intended to illustrate both types of bends. And to further explain some of the terminology employed, a water inlet is an opening defined by the enclosure that functions as means for conveying a flow of water into the hollow interior, a water outlet is an opening defined by the enclosure that functions as means for conveying the flow of water from the hollow interior in the form of a sheet of water, a water-spreading chamber is a chamber defined by the enclosure that functions as means for spreading water as the water flows from the inlet to the outlet, and a chamber-connecting passageway is a passageway defined by the enclosure that functions as means for connecting one chamber in fluid communication with another chamber.

What is claimed is:

1. A water sheeting manifold, comprising:

an enclosure having a hollow interior with first, second, and third water-spreading chambers and first, second, and third chamber-connecting passageways, water inlet means for conveying a flow of water into the hollow interior, and water outlet means for conveying the flow of water from the hollow interior in the form of a sheet of water;

the enclosure including opposite first and second ends and first and second sides extending between the first and second ends;

the first and second ends combining with the first and second sides to cooperatively enclose and define the hollow interior of the enclosure; and the first and second sides including a plurality of sections that cooperate with the first and second ends to define the water-spreading chambers and chamber-connecting passageways without chamber-defining structure and passageway-defining structure within the hollow interior of the enclosure.

2. A water sheeting manifold, comprising:

an enclosure having a hollow interior, water inlet means for conveying a flow of water into the hollow interior, and water outlet means for conveying the flow of water out of the hollow interior in the form of a sheet of water;

the enclosure including opposite first and second ends and first and second sides extending between the first and second ends;

the first and second ends combining with the first and second sides to cooperatively enclose and define the hollow interior of the enclosure; and the first and second sides including a plurality of bends extending between the first and second ends that divide the first and second sides into a plurality of sections; and the plurality of sections cooperating with the first and second ends to define the hollow interior so that the hollow interior includes at least first, second, and third water-spreading chambers and at least first, second, and third chamber-connecting passageways such that the water inlet means is in fluid communication with the first water-spreading chamber, the first chamber-connecting passageway extends between the first and second water-spreading chambers, the second chamber-connecting passageway extends between the second and third water-spreading chambers, and the third chamber-connecting passageway provides fluid communication between the third water-spreading chamber and the water outlet means;

whereby the first, second, and third water-spreading chambers and the first, second, and third chamber-connecting passageways are defined by the plurality of sections and the first and second ends without chamber-defining structure and passageway-defining structure within the hollow interior of the enclosure.

3. A water sheeting manifold as recited in claim 2, wherein the first and second sides of the enclosure are an extruded body of material.

4. A water sheeting manifold as recited in claim 2, wherein the first and second sides of the enclosure are separate components connected together along one of the plurality of bends.

5. A water sheeting manifold, comprising:

an enclosure having a hollow interior, water inlet means for conveying a flow of water into the hollow interior, and water outlet means for conveying the flow of water out of the hollow interior in the form of a sheet of water;

the enclosure including opposite first and second ends and first and second sides extending between the first and second ends;

the first and second sides including a plurality of bends extending between the first and second ends that divide the first and second sides into a plurality of sections; and the plurality of sections cooperating with the first and second ends to define the hollow interior so that the hollow interior includes at least first, second, and third water-spreading chambers and at least first, second, and third chamber-connecting passageways such that the water inlet means is in fluid communication with the first water-spreading chamber, the first chamber-connecting passageway extends between the first and second water-spreading chambers, the second chamber-connecting passageway extends between the second and third water-spreading chambers, and the third chamber-connecting passageway provides fluid communication between the third water-spreading chamber and the water outlet means;

whereby the first, second, and third water-spreading chambers and the first, second, and third chamber-connecting passageways are defined by the plurality of sections and the first and second ends without other chamber-defining structure and passageway-defining structure within the hollow interior of the enclosure;

wherein:

the plurality of bends includes at least eleven bends and the plurality of sections includes at least twelve sections;

a first section of the twelve sections is about 2.125 units wide using a selected linear measurement unit, which first section extends to a first bend of the eleven bends;

a second section of the twelve sections is about 0.75 units wide and extends to a second bend of the eleven bends at an angle facing the hollow interior between the first and second sections of about 135 degrees;

a third section of the twelve sections is about 2.125 units wide and extends from the second bend to a third bend of the eleven bends at an angle facing the hollow interior between the second and third sections of about 90 degrees;

a fourth section of the twelve sections is about 2.0 units wide and extends from the third bend to a fourth bend of the eleven bends at an angle facing the hollow interior between the third and fourth sections of about 100 degrees;

a fifth section of the twelve sections is about 0.875 units wide and extends from the fourth bend to a fifth bend of the eleven bends at an angle facing the hollow interior between the fourth and fifth sections of about 260 degrees;

a sixth section of the twelve sections is about 2.25 units wide and extends from the fifth bend to a sixth bend of the eleven bends at an angle facing the hollow interior between the fifth and sixth sections of about 260 degrees;

a seventh section of the twelve sections is about 1.25 units wide and extends from the sixth bend to a seventh bend of the eleven bends at an angle facing the hollow interior between the sixth and seventh sections of about 155 degrees;

an eighth section of the twelve sections extends from the seventh bend toward the water outlet at an angle facing the hollow interior between the seventh and eighth sections of about 215 degrees;

a ninth section of the twelve sections is about 3.0 units wide and extends from an eighth bend of the eleven bends that is located between the first and ninth sections to a ninth bend of the eleven bends at an angle facing the hollow interior between the first and ninth sections of about 135 degrees;

a tenth section of the twelve sections is about 2.25 units wide and extends from the ninth bend to a tenth bend of the eleven bends at an angle facing the hollow interior between the ninth and tenth sections of about 80 degrees;

an eleventh section of the twelve sections is about 0.625 units wide and extends from the tenth bend to an eleventh bend of the eleven bends at an angle facing the hollow interior between the tenth and eleventh sections of about 280 degrees; and a twelfth section of the twelve sections extends from the eleventh bend toward the water outlet at an angle facing the hollow interior between the eleventh and twelfth sections of about 90 degrees.

6. A water sheeting manifold, comprising:

an enclosure having a hollow interior, water inlet means for conveying a flow of water into the hollow interior, and water outlet means for conveying the flow of water out of the hollow interior in the form of a sheet of water;

the enclosure including opposite first and second ends and first and second sides extending between the first and second ends;

the first and second sides including a plurality of bends extending between the first and second ends that divide the first and second sides into a plurality of sections; and the plurality of sections cooperating with the first and second ends to define the hollow interior so that the hollow interior includes at least first, second, and third water-spreading chambers and at least first, second, and third chamber-connecting passageways such that the water inlet means is in fluid communication with the first water-spreading chamber, the first chamber-connecting passageway extends between the first and second water-spreading chambers, the second chamber-connecting passageway extends between the second and third water-spreading chambers, and the third chamber-connecting passageway provides fluid communication between the third water-spreading chamber and the water outlet means;

whereby the first, second, and third water-spreading chambers and the first, second, and third chamber-connecting passageways are defined by the plurality of sections and the first and second ends without other chamber-defining structure and passageway-defining structure within the hollow interior of the enclosure;

wherein:

the plurality of bends includes at least eleven bends and the plurality of sections includes at least twelve sections;

a first section of the twelve sections is about 2.125 units wide using a selected linear measurement unit, which first section extends to a first bend of the eleven bends;

a second section of the twelve sections is about 0.75 units wide and extends from the first bend to a second bend of the eleven bends at an angle facing the hollow interior between the first and second sections of about 135 degrees;

a third section of the twelve sections is about 2.125 units wide and extends from the second bend to a third bend of the eleven bends at an angle facing the hollow interior between the second and third sections of about 90 degrees;

a fourth section of the twelve sections is about 2.0 units wide and extends from the third bend to a fourth bend of the eleven bends at an angle facing the hollow interior between the third and fourth sections of about 100 degrees;

a fifth section of the twelve sections is about 0.875 units wide and extends from the fourth bend to a fifth bend of the eleven bends at an angle facing the hollow interior between the fourth and fifth sections of about 260 degrees;

a sixth section of the twelve sections is about 2.25 units wide and extends from the fifth bend to a sixth bend of the eleven bends at an angle facing the hollow interior between the fifth and sixth sections of about 260 degrees;

a seventh section of the twelve sections extends from the sixth bend toward the water outlet at an angle facing the hollow interior between the seventh and eighth sections of about 155 degrees;

an eighth section of the twelve sections is about 3.0 units wide and extends from a seventh bend of the eleven bends that is located between the first and eighth sections to an eighth bend of the eleven bends at an angle facing the hollow interior between the first and eighth sections of about 135 degrees;

a ninth section of the twelve sections is about 2.25 units wide and extends from the eighth bend to a ninth bend of the eleven bends at an angle facing the hollow interior between the eighth and ninth sections of about 80 degrees;

a tenth section of the twelve sections is about 0.625 units wide and extends from the ninth bend to a tenth bend of the eleven bends at an angle facing the hollow interior between the ninth and tenth sections of about 280 degrees;

an eleventh section of the twelve sections is about 1.25 units wide and extends from the tenth bend to an eleventh bend of the eleven bends at an angle facing the hollow interior between the tenth and eleventh section of about 90 degrees; and a twelfth section of the twelve sections extends toward the water outlet at an angle facing the hollow interior between the eleventh and twelfth sections of about 215 degrees.

7. A water sheeting manifold, comprising:

an enclosure having a hollow interior, water inlet means for conveying a flow of water into the hollow interior, water outlet means for conveying the flow of water out of the hollow interior in the form of a sheet of water, opposite first and second ends, and first and second sides extending between the first and second ends;

the first and second sides of the enclosure including at least eleven bends extending between the first and second ends of the enclosure that divide the first and second sides into at least twelve sections; and the twelve sections cooperating with the first and second ends to define the hollow interior so that the hollow interior includes first, second, and third water-spreading chambers and first, second, and third chamber-connecting passageways such that the water inlet means is in fluid communication with the first water-spreading chamber, the first chamber-connecting passageway extends between the first and second water-spreading chambers, the second chamber-connecting passageway extends between the second and third water-spreading chambers, and the third chamber-connecting passageway extends between the third water-spreading chamber and the water outlet means;

a first section of the twelve sections that is about 2.125 units wide using a selected linear measurement unit, which first section extends to a first bend of the eleven bends;

a second section of the twelve sections that is about 0.75 units wide and extends to a second bend of the eleven bends at an angle facing the hollow interior between the first and second sections of about 135 degrees;

a third section of the twelve sections that is about 2.125 units wide and extends from the second bend to a third bend of the eleven bends at an angle facing the hollow interior between the second and third sections of about 90 degrees;

a fourth section of the twelve sections that is about 2.0 units wide and extends from the third bend to a fourth bend of the eleven bends at an angle facing the hollow interior between the third and fourth sections of about 100 degrees;

a fifth section of the twelve sections that is about 0.875 units wide and extends from the fourth bend to a fifth bend of the eleven bends at an angle facing the hollow interior between the fourth and fifth sections of about 260 degrees;

a sixth section of the twelve sections that is about 2.25 units wide and extends from the fifth bend to a sixth bend of the eleven bends at an angle facing the hollow interior between the fifth and sixth sections of about 260 degrees;

a seventh section of the twelve sections that is about 1.25 units wide and extends from the sixth bend to a seventh bend of the eleven bends at an angle facing the hollow interior between the sixth and seventh sections of about 155 degrees;

an eighth section of the twelve sections that extends from the seventh bend toward the water outlet at an angle facing the hollow interior between the seventh and eighth sections of about 215 degrees;

a ninth section of the twelve sections that is about 3.0 units wide and extends from an eighth bend of the eleven bends that is located between the first and ninth sections to a ninth bend of the eleven bends at an angle facing the hollow interior between the first and ninth sections of about 135 degrees;

a tenth section of the twelve sections that is about 2.25 units wide and extends from the ninth bend to a tenth bend of the eleven bends at an angle facing the hollow interior between the ninth and tenth sections of about 80 degrees;

an eleventh section of the twelve sections that is about 0.625 units wide and extends from the tenth bend to an eleventh bend of the eleven bends at an angle facing the hollow interior between the tenth and eleventh sections of about 280 degrees; and a twelfth section of the twelve sections that extends from the eleventh bend toward the water outlet at an angle facing the hollow interior between the eleventh and twelfth sections of about 90 degrees;

whereby the water-spreading chambers and the chamber-connecting passageways are defined by the plurality of sections and the first and second ends without other chamber-defining structure and passageway-defining structure within the interior of the enclosure.

8. A water sheeting manifold, comprising:

an enclosure having a hollow interior, water inlet means for conveying a flow of water into the hollow interior, water outlet means for conveying the flow of water out of the hollow interior in the form of a sheet of water, opposite first and second ends, and first and second sides extending between the first and second ends;

the first and second sides of the enclosure including at least eleven bends extending between the first and second ends of the enclosure that divide the first and second sides into at least twelve sections; and the twelve sections cooperating with the first and second ends to define the hollow interior so that the hollow interior includes first, second, and third water-spreading chambers and first, second, and third chamber-connecting passageways such that the water inlet means is in fluid communication with the first water-spreading chamber, the first chamber-connecting passageway extends between the first and second water-spreading chambers, the second chamber-connecting passageway extends between the second and third water-spreading chambers, and the third chamber-connecting passageway extends between the third water-spreading chamber and the water outlet means;

a first section of the twelve sections that is about 2.125 units wide using a selected linear measurement unit, which first section extends to a first bend of the eleven bends;

a second section of the twelve sections that is about 0.75 units wide and extends from the first bend to a second bend of the eleven bends at an angle facing the hollow interior between the first and second sections of about 135 degrees;

a third section of the twelve sections that is.about 2.125 units wide and extends from the second bend to a third bend of the eleven bends at an angle facing the hollow interior between the second and third sections of about 90 degrees;

a fourth section of the twelve sections that is about 2.0 units wide and extends from the third bend to a fourth bend of the eleven bends at an angle facing the hollow interior between the third and fourth sections of about 100 degrees;

a fifth section of the twelve sections that is about 0.875 units wide and extends from the fourth bend to a fifth bend of the eleven bends at an angle facing the hollow interior between the fourth and fifth sections of about 260 degrees;

a sixth section of the twelve sections that is about 2.25 units wide and extends from the fifth bend to a sixth bend of the eleven bends at an angle facing the hollow interior between the fifth and sixth sections of about 260 degrees;

a seventh section of the twelve sections that extends from the sixth bend toward the water outlet at an angle facing the hollow interior between the seventh and eighth sections of about 155 degrees;

an eighth section of the twelve sections that is about 3.0 units wide and extends from a seventh bend of the eleven bends that is located between the first and eighth sections to an eighth bend of the eleven bends at an angle facing the hollow interior between the first and eighth sections of about 135 degrees;

a ninth section of the twelve sections that is about 2.25 units wide and extends from the eighth bend to a ninth bend of the eleven bends at an angle facing the hollow interior between the eighth and ninth sections of about 80 degrees;

a tenth section of the twelve sections that is about 0.625 units wide and extends from the ninth bend to a tenth bend of the eleven bends at an angle facing the hollow interior between the ninth and tenth sections of about 280 degrees;

an eleventh section of the twelve sections that is about 1.25 units wide and extends from the tenth bend to an eleventh bend of the eleven bends at an angle facing the hollow interior between the tenth and eleventh section of about 90 degrees; and a twelfth section of the twelve sections that extends toward the water outlet at an angle facing the hollow interior between the eleventh and twelfth sections of about 215 degrees;

whereby the water-spreading chambers and the chamber-connecting passageways are defined by the plurality of sections and the first and second ends without other chamber-defining structure and passageway-defining structure within the interior of the enclosure.

* * * * *